United States Patent [19]

Ellis

[11] 4,433,780

[45] Feb. 28, 1984

[54] GREETING CARD

[76] Inventor: Karen E. Ellis, 8012 S. Drexel, Chicago, Ill. 60619

[21] Appl. No.: 321,390

[22] Filed: Nov. 16, 1981

[51] Int. Cl.[3] ..... B65D 85/00; B65D 85/672; B65D 73/00

[52] U.S. Cl. ..... 206/232; 206/387; 206/459

[58] Field of Search ..... 206/45.11, 232, 233, 206/387, 424, 459

[56] References Cited

U.S. PATENT DOCUMENTS

| | | | |
|---|---|---|---|
| 409,703 | 8/1889 | Proctor | 206/45.11 |
| 2,799,391 | 7/1957 | Eisner | 206/232 |
| 4,108,307 | 8/1978 | Feingold et al. | 206/387 |

FOREIGN PATENT DOCUMENTS

| | | | |
|---|---|---|---|
| 2731293 | 2/1979 | Fed. Rep. of Germany | 206/387 |
| 1533071 | 11/1978 | United Kingdom | 206/387 |

*Primary Examiner*—William T. Dixson, Jr.
*Assistant Examiner*—Brenda J. Ehrhardt
*Attorney, Agent, or Firm*—George H. Gerstman

[57] ABSTRACT

A greeting card is provided which comprises a foldable member formed of cover stock and carrying thereon a receptacle having a configuration that is complementary to the configuration of a standard audio cassette, for snugly receiving a standard audio cassette.

1 Claim, 5 Drawing Figures

FIG. 2
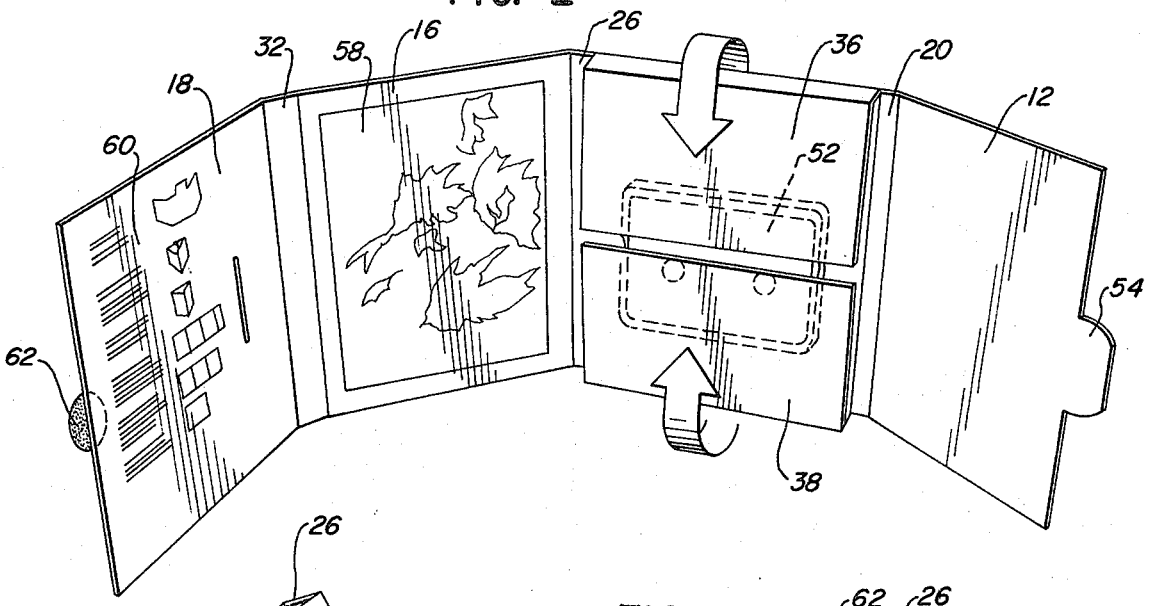
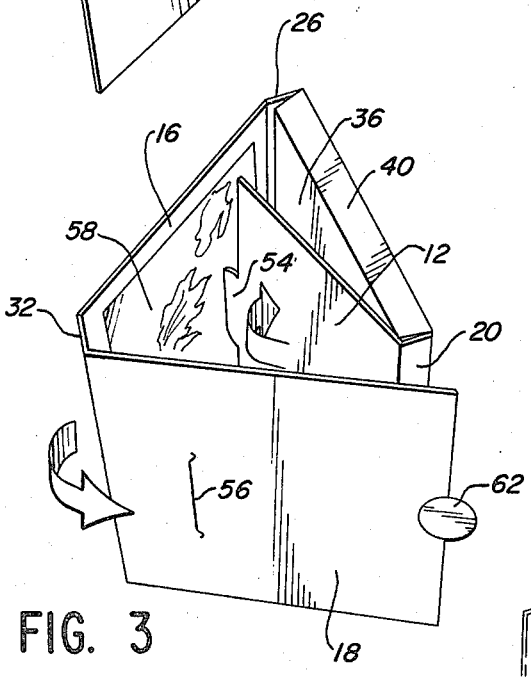
FIG. 3
FIG. 4
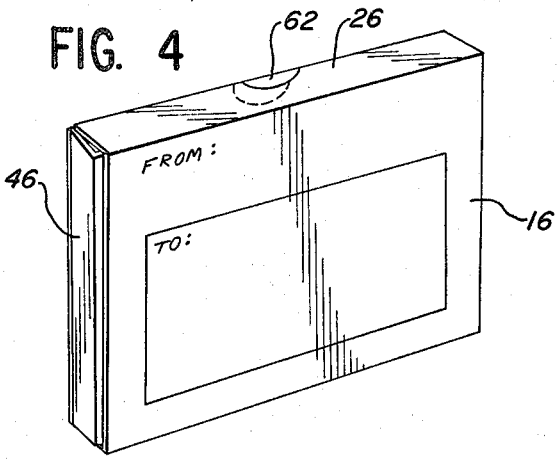
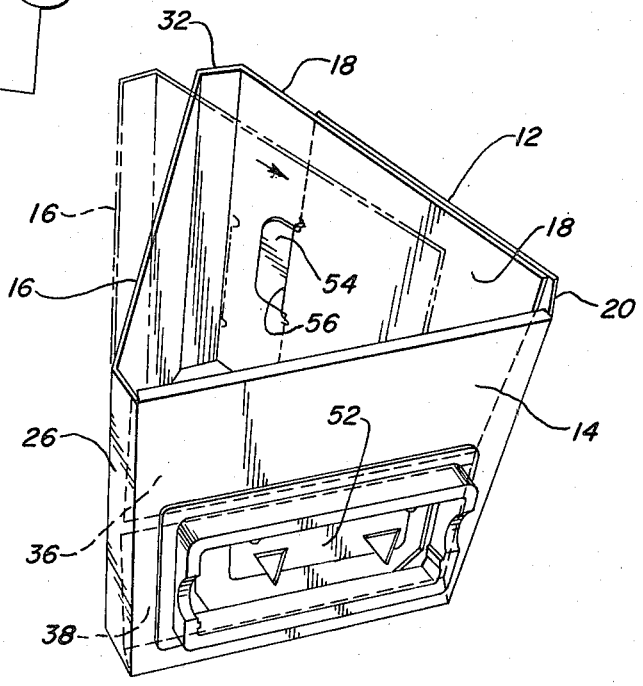
FIG. 5

GREETING CARD

SUMMARY OF THE INVENTION

The present invention concerns a novel greeting card.

In accordance with the present invention, a greeting card is provided which comprises a foldable member formed of cover stock and carrying thereon means for receiving an audio cassette.

In the illustrative embodiment, the receiving means comprises a receptacle having a configuration that is complementary to the configuration of a standard audio cassette, for snugly receiving a standard audio cassette. The foldable member comprises a member having flaps which are foldable to provide a rectilinear box-type configuration when folded.

The audio cassette receiving means are connected to the foldable member in a location whereby when the foldable member is folded, the receiving means is enclosed within the box-type configuration.

The foldable member is also operable to form an upstanding display-type structure when it is folded in a direction that is opposite to the direction of folding to form a box-type configuration.

In the illustrative embodiment, the foldable member comprises at least three continuous panels having a pair of score lines intermediate each of the panels.

A more detailed explanation of the invention is provided in the following description and claims, and is illustrated in the accompanying drawings.

BRIEF DESCRIPTION OF THE DRAWINGS

FIG. 2 is a perspective view thereof, showing the greeting card as it is being folded, with arrows to indicate direction;

FIG. 3 is similar to FIG. 2, but FIG. 3 shows the greeting card in a more folded condition;

FIG. 4 is a perspective view of the greeting card in its completely folded and closed condition; and FIG. 5 is a perspective view of the greeting card in its condition as an upstanding display-type structure, with phantom lines being used to illustrate how the card is folded to achieve the upstanding display-type structure.

DETAILED DESCRIPTION OF THE ILLUSTRATIVE EMBODIMENT

Figure 1:
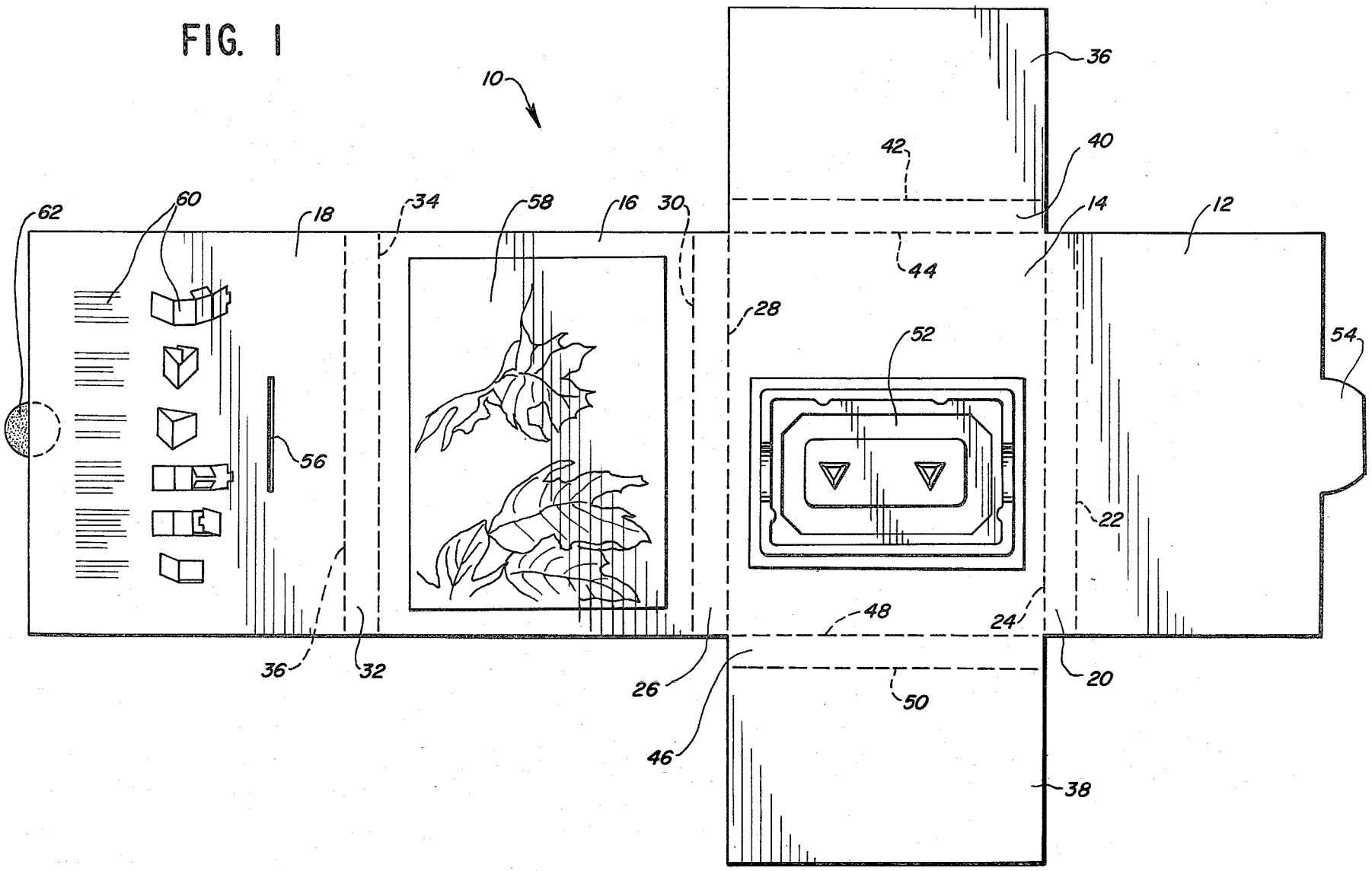
FIG. 1 is a front view of a greeting card constructed in accordance with the principles of the present invention, in its completely opened form.

Referring to the drawings, FIG. 1 shows a greeting card 10 constructed in accordance with the principles of the present invention. Greeting card 10 is formed of 80 lb. cover stock and comprises a first panel 12, a second panel 14, a third panel 16 and a fourth panel 18. Panels 12 and 14 are separated from each other by a first intermediate portion 20 defined by a pair of fold lines 22, 24. Second panel 14 is separated from third panel 16 by a second intermediate portion 26, defined by a pair of fold lines 28, 30. Third panel 16 is separated from fourth panel 18 by a third intermediate portion 32, defined by fold lines 34, 36. It will be noted that fold lines 24 and 28 also define second panel 14 while fold lines 30 and 34 define third panel 16.

A pair of flaps 36, 38 extend outwardly from second panel 14. Flap 36 is separated from panel 14 by intermediate portion 40 defined by a pair of fold lines 42, 44. Flap 38 is separated from panel 14 by intermediate portion 46 defined by a pair of fold lines 48, 50. It is noted that panel 14 is defined by fold lines 44, 24, 48 and 28.

A significant feature of the present invention resides in the providing of means carried by one of the panels for receiving an audio cassette. In the illustrative embodiment, an audio cassette receptacle 52 is fastened, preferably by adhesive, to panel 14. Receptacle 52 has a configuration that is complementary to the configuration of a standard audio cassette for snugly receiving a standard audio cassette.

First panel 12 has a tab 54 which extends from its distal end. Fourth panel 18 defines a slot 56 for receiving tab 54 as will be described below.

Decorative items may be provided on the various panels as desired. For example, a photograph 58 is illustrated as imprinted on panel 16, and instructions 60 are illustrated as imprinted on panel 18.

The greeting card may be folded to form the box-type configuration illustrated in FIG. 4. As illustrated in FIG. 4, one side of panel 16 may contain an address area.

In order to form the box-type configuration of FIG. 4, reference is made to FIGS. 2 and 3. First an audio cassette is provided with the sender's message or any other audio material which the sender wishes to provide. The audio cassette is placed into receptacle 52 and flaps 36 and 38 are folded over panel 14 as illustrated. Now referring to FIG. 3, it is seen that panel 12 is folded over flaps 36 and 38 and then the composite of panel 12, flaps 36, 38 and panel 14 is folded over panel 16. Panel 18 is then folded over the back of panel 14 to form the box-type configuration of FIG. 4, and a pressure-sensitive seal 62 may be applied to the back of intermediate portion 26 to seal the unit.

As illustrated in FIG. 5, the greeting card may be folded to form an upstanding display-type structure. To this end, flaps 36 and 38 are folded around the back of panel 14 and panels 12, 16 and 18 are also folded in reverse so that tab 54 will enter slot 56 of panel 18. It can be seen that the display structure essentially has a triangular horizontal cross-sectional configuration, with one side of the triangle being formed by panel 14, another side being formed by panel 16 and another side being formed by panels 12 and 18 in overlapping relationship.

Although an illustrative embodiment of the invention has been shown and described, it is to be understood that various modifications and substitutions may be made by those skilled in the art without departing from the spirit and scope of the present invention.

What is claimed is:

1. A greeting card in the form of a folded rectilinear box which comprises:

a foldable member formed of cover stock and carrying thereon means for receiving an audio cassette;

said receiving means comprising a receptacle having a configuration that is complementary to the configuration of a standard audio cassette for snugly receiving a standard audio cassette;

said receptacle being connected to said foldable member in a location whereby when the foldable member is folded, said receptacle being enclosed within said rectilinear box;

said rectilinear box being formed from said foldable member comprising a first panel, a second panel, a third panel and a fourth panel; the first panel being separated from the second panel by a first intermediate portion defined by two fold lines; said second panel being separated from the third panel by a second intermediate portion defined by two fold lines; said fourth panel being separated from the third panel by a third intermediate panel defined by two fold lines; a pair of flaps extending outwardly from said second panel, each of said flaps being separated from said second panel by a portion defined by two fold lines;

means for connecting said first panel to said fourth panel;

said foldable member also being formed into an upstanding display-type structure when it is folded in a direction that is opposite to the direction of folding to form said rectilinear box and when said first panel is connected to said fourth panel.

* * * * *